US006176520B1

(12) United States Patent
Himmelwright et al.

(10) Patent No.: US 6,176,520 B1
(45) Date of Patent: Jan. 23, 2001

(54) METHOD AND ARTICLE FOR PERSONALIZING THE PROMOTION OF AN INSTITUTION OR ORGANIZATION

(76) Inventors: Quintin Himmelwright, 810 N. 4th St., Salina, KS (US) 67401; Terry Watkins, P.O. Box 211, Salina, KS (US) 67402; Judy Fisk, 608 1/2 E. Iron; Debra McClelland, 1920 Dover Driver, both of Salina, KS (US) 67401

( * ) Notice: Under 35 U.S.C. 154(b), the term of this patent shall be extended for 0 days.

(21) Appl. No.: 09/542,330

(22) Filed: Apr. 4, 2000

(51) Int. Cl.[7] ..... B42D 15/00

(52) U.S. Cl. ..... 283/67; 283/70; 283/74; 283/56

(58) Field of Search ..... 283/67, 70, 74, 283/56, 77, 45, 46; 40/218; 473/176; D11/95, 109, 165

(56) References Cited

U.S. PATENT DOCUMENTS

| | | | | |
|---|---|---|---|---|
| 4,038,767 | | 8/1977 | Chasin et al. . | |
| 4,542,757 | | 9/1985 | Phillips . | |
| 5,400,437 | * | 3/1995 | Koutras | 2/84 |
| 5,509,109 | * | 4/1996 | Kim et al. | 345/114 |
| 5,597,226 | | 1/1997 | Fast . | |
| 5,881,391 | | 3/1999 | Mullaney . | |

* cited by examiner

*Primary Examiner*—Willmon Fridie, Jr.
(74) *Attorney, Agent, or Firm*—Dale J. Ream

(57) ABSTRACT

A method and article for advertising and promoting an institution or organization comprises providing a flag formed of a flexible material and having a portion thereof coated with a material which provides a smoother surface and greater retention of marks from a writing instrument. The flag includes a first indicia which includes the name of an institution or organization to be promoted and a second indicia which includes the picture or name of a person associated with the named institution or organization. The coated surface of the flag is adapted to receive and retain the signature of the person portrayed by the second indicia. A third indicia is carried on the flag which includes a textual expression of aggressive loyalty to the person and organization identified on the flag. The method for advertising and promoting the institution or organization includes the steps of providing a flag as described above and distributing it to a consumer. As the consumer displays the flag, identifies with its aggressive message, and personally seeks the signature of the person portrayed thereon, loyalty and allegiance to the institution or organization are promoted, resulting in a financial benefit thereto.

20 Claims, 2 Drawing Sheets

10
10
12

18
16
12
29
20
24
14
26
22
28
TRY
BURNING
THIS ONE

METHOD AND ARTICLE FOR PERSONALIZING THE PROMOTION OF AN INSTITUTION OR ORGANIZATION

BACKGROUND OF THE INVENTION

The present invention relates generally to the field of marketing and advertising and, more particularly, to a method and article for personalizing the advertising and promotion of an institution or organization.

Universities, professional sporting associations, and other institutions and organizations are concerned with maintaining the loyalty and allegiance of their alumni or fans. It is well known that maintaining a high level of loyalty and support translates into significant economic benefit to the institution or organization through attendance, enrollment, merchandising, etc. Fan loyalty has in the past been promoted through the sale of clothing or other merchandise bearing the name, logo, or mascot associated with the organization. However, this simplistic method of advertising and promotion does not optimize the emotional feelings of loyalty and allegiance to the institution or organization.

Therefore, it is desirable to have a method and article for aggressively promoting loyalty and allegiance to an institution or organization by encouraging personal action by the consumer. It is further desirable to have a method and article which encourages and facilitates the formation of a personal identification between a consumer and a person associated with the institution or organization being promoted. It is also desirable to have a method and article which associates a consumer with an aggressive statement reflecting the consumer's personal loyalty, allegiance, and commitment to the institution or organization.

SUMMARY OF THE INVENTION

A method for advertising and promoting an institution or organization includes providing a flag, or other article of manufacture, having attributes particularly configured to evoke strong feelings of loyalty and allegiance from a user. The flag includes an arrangement of indicia naming and being associated with a particular institution or organization. Indicia carried by the flag include a logo or mascot associated with the institution or organization as well as an image indicative of a person readily recognizable as being associated with the institution or organization.

The flag, or other article, further includes a portion that is coated with a substance which provides a surface that is smoother than the flag material and provides greater retention of marks from a writing instrument such as a permanent marker. The use of this coating encourages the consumer to obtain the personal signature of the person whose image appears on the flag, whether the person is a well-known athlete, spokesperson, or celebrity. The personal identification of a consumer with a well known public personality increases the consumer's allegiance to the organization endorsed or represented by the well known person.

In addition, the flag or other article includes a slogan which conveys a willingness and desire by the consumer to defend his allegiance to the institution or organization. Preferably, the slogan is "Try Burning This One™" which rhetorically challenges opponents of the institution or organization to criticize or attempt to destroy the promotional article. Encouraging a consumer to personally defend his allegiance to the organization promotes a high degree of loyalty and future support. The present method includes the steps of distributing the particular articles to consumers who desire to be identified with the institution or organization. As the consumers thereafter display the articles, such as at sporting or social events, the institution or organization is aggressively promoted.

Therefore, a general object of this invention is to provide a method and article for personalizing the promotion of an institution or organization.

Another object of this invention is to provide a method and article, as aforesaid, which includes a flag having a plurality of indicia naming and being associated with an institution or organization.

Still another object of this invention is to provide a method and article, as aforesaid, in which the flag includes an image of a person associated with the institution or organization.

Yet another object of this invention is to provide a method and article, as aforesaid, in which the flag includes a portion particularly adapted to receive the personal signature of the person whose image is imprinted upon the flag.

A further object of this invention is to provide a method and article, as aforesaid, in which the flag includes a slogan which aggressively asserts a consumer's personal loyalty and allegiance to the institution or organization.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A method and article of manufacture for personalizing the advertising and promotion of an institution or organization according to a preferred embodiment of the present invention is shown in and will be described with reference to FIGS. 1 and 2.

The method for personalizing the promotion of an institution or organization, such as a college, university, professional sporting association or team, etc., includes providing a flag 10 having a combination of attributes and indicia which optimize a consumer's personal feelings of loyalty and allegiance. The flag 10 is constructed of a nylon material so as to be both flexible and durable although materials such as cloth, polyester, or synthetic combinations would also be suitable. A rectangular portion 14 of the flag 10 is coated with a substance such as a melamine resin or rubber so as to provide a surface that is smoother than the rest of the nylon flag surface. A melamine coating provides a surface particularly adapted to receive a personal signature thereon with a permanent marker or the like, as to be more fully described below.

Figures 1, 2:
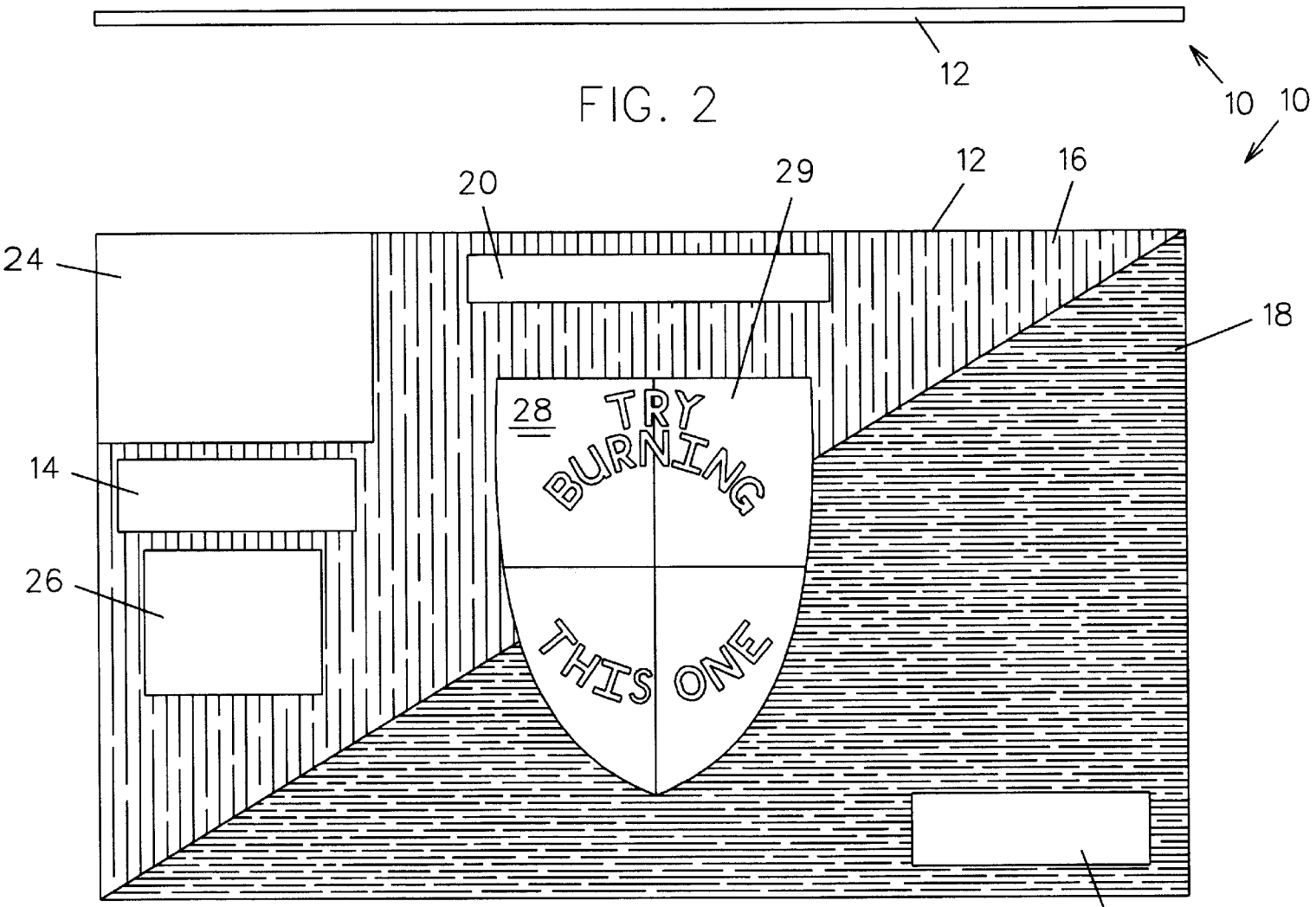
FIG. 1 is a front view of a flag according to the preferred embodiment of the present invention, the opposite side being a mirror image of the side shown and color being depicted schematically.
FIG. 2 is a top edge view of the flag as in claim 1.

The flag is divided diagonally into first 16 and second 18 portions, each portion presenting a different color (FIG. 1). The flag 10 includes various indicia, textual and pictorial, arranged and combined so as to promote a particular institution or organization. A first indicia 20 imprinted upon the first portion 16 of the flag 10 is the name of the institution or organization being promoted. The first indicia 20 is preferably positioned near a top edge 12 of the flag and equally spaced apart from either side thereof. A second indicia 22 comprises a logo, image of a mascot, or other emblem strongly associated with the institution or organization indicated by the first indicia 20. The second indicia 22 is carried by the flag 10 in the lower right-hand portion of the second portion 18 (FIG. 1).

A third indicia 24 carried by the flag 10 includes an image of a person associated with the institution or organization. The third indicia 24 may be in the form of a photograph or illustration and is preferably positioned in the upper left-hand portion of the first portion 16 of the flag 10. If the person represented by the third indicia image is an athlete, e.g. a football player, racecar driver, etc., then a fourth indicia 26 being the number associated with that athlete is carried on the first portion 16 of the flag 10 spaced from the third indicia image 24. The coated portion 14 described above is positioned intermediate the third 24 and fourth 26 indicia.

The flag 10 includes a fifth indicia 28 centered thereon and thus overlapping portions of the first 16 and second 18 portions thereof. The fifth indicia 28 includes the trademark slogan, "Try Burning This One™" imprinted within the borders of a shield 29, the shield 29 being graphically divided into four quadrants. The quadrants may include colors associated with the institution or organization indicated by the first indicia 20.

It is understood that each indicia described above may be imprinted upon the flag, sewn thereto, or affixed thereto in any other suitable manner. The opposite side of the flag 10 is a mirror image of the side shown in FIG. 1 and described above.

In use, the method for personalizing the promotion of a particular institution or organization includes providing a flag 10 having different indicia associated with the institution or organization as described above as well as having a portion of the flag 10 coated with a substance that is smoother than the rest of the flag and better able to be marked upon. By providing this construction, a consumer is encouraged to seek out the person shown on the flag 10 and to obtain that person's signature thereupon. Promotion of the institution or organization is enhanced by distributing the flags to consumers who desire to be identified with the institution or organization and encouraging each consumer to personally take action in order to publicly demonstrate loyalty and allegiance to the institution or organization.

The institution or organization is further promoted to the consumer who obtains one of the flags 10 by the slogan "Try Burning This One™" which is imprinted thereon. This aggressive statement carries with it the analogous patriotic boldness to defend that to which one has pledged allegiance. In this case, the consumer is, in effect, pledging his allegiance to the institution or organization that is indicated by the other indicia on the flag. Again, promotion of the institution or organization is enhanced by encouraging the public display of a deeper allegiance thereto by the consumer.

Figure 3:
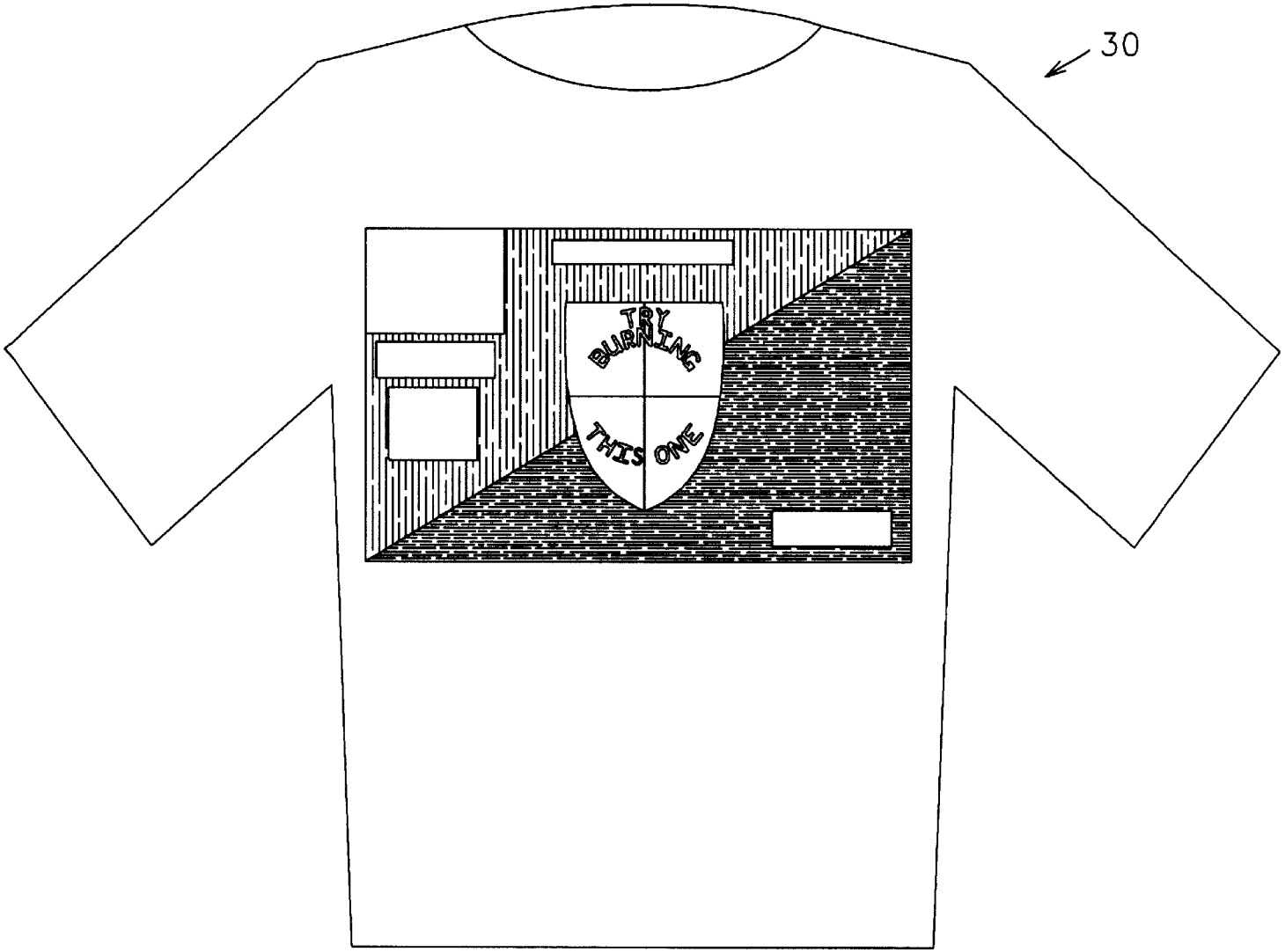
FIG. 3 is a front view of a T-shirt according to an alternative embodiment of the present invention.

As shown in FIG. 3, an alternative embodiment of this method involves providing a T-shirt 30 having the same configuration of indicia as described above. Promotion of the institution or organization is personalized by the consumer wearing the shirt 30 in public. It is understood that other articles of clothing may be provided having identical indicia, such as caps, headbands, jackets, etc. It should be further appreciated that other articles of manufacture having similar indicia may also be provided.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A method for personalizing the promotion of an institution or organization, comprising the steps of:

providing a flag formed of a flexible material and having a portion coated with a material which provides a smooth surface and greater retention of marks from a writing instrument;

providing a first indicia on said flag which includes a name indicative of an institution or organization;

providing a second indicia on said flag which includes an image indicative of a person associated with the institution or organization indicated by said first indicia;

providing a third indicia on said flag which includes a slogan indicative of aggressive loyalty to the person indicated by said second indicia or the organization or institution indicated by said first indicia;

distributing said flag to a consumer who desires to be identified with the person indicated by said second indicia or the organization or institution indicated by said first indicia; and said consumer publicly displaying said flag.

2. A method as in claim 1 further comprising the step of providing a fourth indicia on said flag which includes an image indicative of the institution or organization indicated by said first indicia.

3. A method as in claim 2 further comprising the step of obtaining upon said coated portion of said flag the signature of the person indicated by said second indicia.

4. A method as in claim 2 wherein said fourth indicia is a logo.

5. A method as in claim 1 further comprising the step of obtaining upon said coated portion of said flag the signature of said person indicated by said second indicia.

6. A method as in claim 1 wherein said second indicia is a photograph of a person.

7. A method as in claim 1 wherein said second indicia is a name of a person.

8. A method for personalizing the advertising and promotion of an organization, comprising the steps of:

producing an article of clothing;

coating a portion of said article with a material which provides a smoother surface and greater retention of marks from a writing instrument;

providing a first indicia on said clothing article which includes a name of an institution or organization;

providing a second indicia on said clothing article which includes an image indicative of a person associated with the institution or organization indicated by said first indicia;

providing a third indicia on said clothing article which includes a textual expression of allegiance to the person indicated by said second indicia or the organization or institution indicated by said first indicia;

distributing said clothing article to a consumer who desires to be identified with the person indicated by said second indicia or the organization or institution indicated by said first indicia; and said consumer wearing said clothing article.

9. A method as in claim 8 further comprising the step of providing a fourth indicia on said clothing article which includes a logo indicative of the institution or organization indicated by said first indicia.

10. A method as in claim 9 further comprising the step of obtaining upon said coated portion of said clothing article the signature of the person indicated by said second indicia.

11. A method as in claim 8 further comprising the step of obtaining upon said coated portion of said clothing article the signature of said person indicated by said second indicia.

12. A method as in claim 8 wherein said second indicia is an illustration of a person.

13. A method as in claim 8 wherein said second indicia is a photograph of a person.

14. A method as in claim 8 wherein said second indicia is a name of a person.

15. A method as in claim 8 wherein said material used for coating said portion of said flag is a melamine resin.

16. An article of manufacture for use in personalizing the advertising or promoting an institution or organization, comprising:

a flag formed of a flexible material and including a portion coated with a material that provides a smoother surface and greater retention of marks from a writing instrument, said coated portion adapted to have a signature marked thereon;

a first indicia on said flag which includes a name indicative of an institution or organization;

a second indicia on said flag which includes an image indicative of a person associated with the institution or organization indicated by said first indicia; and a third indicia on said flag which includes a textual expression of aggressive loyalty to the person indicated by said second indicia or the organization or institution indicated by said first indicia.

17. An article as in claim 16 further comprising a fourth indicia on said flag which includes an image indicative of the institution or organization indicated by said first indicia.

18. An article as in claim 16 wherein said coated portion is coated with a melamine resin.

19. An article as in claim 17 wherein said fourth indicia is a logo.

20. An article as in claim 16 wherein said second indicia is a photograph.

* * * * *